US005857320A

United States Patent [19]

Amos et al.

[11] Patent Number: 5,857,320

[45] **Date of Patent: *Jan. 12, 1999**

[54] COMBUSTOR WITH FLASHBACK ARRESTING SYSTEM

[75] Inventors: David Joseph Amos; Donald Maurice Newburry, both of Orlando; Richard Hobert Bunce, Altamonte Springs, all of Fla.

[73] Assignee: Westinghouse Electric Corporation, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 746,328

[22] Filed: Nov. 12, 1996

[51] Int. Cl.[6] ..... F02C 9/26

[52] U.S. Cl. ..... 60/39.06; 60/39.091; 60/737

[58] Field of Search ..... 60/39.03, 39.06, 60/39.091, 39.281, 737, 747

[56] References Cited

U.S. PATENT DOCUMENTS

| | | | |
|---|---|---|---|
| 3,504,490 | 4/1970 | Klamm | 60/39.091 |
| 3,765,820 | 10/1973 | Ito et al. . | |
| 4,336,783 | 6/1982 | Henson . | |
| 4,421,476 | 12/1983 | Gulden et al. . | |
| 4,682,578 | 7/1987 | Schmidt . | |
| 5,148,667 | 9/1992 | Morey | 60/39.091 |
| 5,257,496 | 11/1993 | Brown | 60/39.06 |
| 5,361,586 | 11/1994 | McWhirter et al. | 60/737 |
| 5,533,329 | 7/1996 | Ohyama et al. . | |

FOREIGN PATENT DOCUMENTS

| | | |
|---|---|---|
| 0816760 | 1/1998 | European Pat. Off. . |
| 2274869 | 1/1976 | France . |
| 3918760 | 12/1990 | Germany . |

OTHER PUBLICATIONS

Rosemount Aerospace™ Flame Detector Relay Output Model 0705MA1 Instruction Manual,Rosemount Aerospace, Inc., Eagan, Minnesota, Dec. 1995.

Ametek Solid–State Sensor Technology Brochure, Ametek Power & Industrial Products, Wilmington, Massachusetts.

*Primary Examiner*—Louis J. Casaregola

*Attorney, Agent, or Firm*—Daniel C. Abeles; Eckert Seamens Cherin & Mellott, LLC

[57] ABSTRACT

A combustor with a flashback arresting system for producing a hot gas by burning premixed fuel and compressed air having fuel/air premixing passages, each of the passages having an inlet end and a discharge end. Disposed immediately upstream of the inlet ends of the fuel/air premixing passages is a fuel manifold for delivering fuel to the passages. Fuel lines with fuel flow control valves connect the fuel manifold with a fuel supply. The flashback arresting system has one or more optical flame detectors with a light receiving portion located upstream of the discharge ends of the fuel/air premixing passages and oriented toward at least a portion of at least one of the fuel/air passages. The flame detectors are responsive to receiving light from a flashback by its light receiving portion by transmitting an output signal to a control system. The control system controls the fuel flow control valves and responds to the output signal by adjusting the fuel flow control valves to eliminate the flashback.

10 Claims, 2 Drawing Sheets

COMBUSTOR WITH FLASHBACK ARRESTING SYSTEM

FIELD OF THE INVENTION

The present invention relates to a combustor for burning premixed fuel and compressed air. More specifically, the present invention relates to a combustor that can arrest flashback.

DESCRIPTION OF THE RELATED ART

In a gas turbine, fuel is burned with compressed air, produced by a compressor, in one or more combustors. An example of such a combustor is disclosed in U.S. Pat. No. 5,361,586 to McWhirter et al. entitled "Gas Turbine Ultra Low NOx Combustor" (the '586 patent), incorporated by reference herein in its entirety.

Damage can quickly occur to the combustor when flashback occurs in its fuel/air premixing passages. During desirable operation of the combustor, the premixed fuel and air combust downstream of the fuel/air premixing passages in the combustion zone. During flashback, the fuel and air mixture in the premixing passages combusts.

The related art discloses using thermocouples connected to the fuel delivery control system to detect and arrest flashback. The thermocouples are mounted in the air/fuel premixing passages. When the thermocouples heat up during flashback, they send a signal to the fuel delivery control system. The control system then arrests fuel delivery, thereby cutting off the flashback's fuel supply and arresting the flashback.

However, a thermocouple flashback arrest system has several limitations. The system's thermocouple thermal response time slows the system response resulting in flashback occurring for a relatively long time before the system can respond. Additionally, the thermocouples need to be installed in the fuel/air premixing passages, where they may disrupt the air/fuel mixture flow in the combustor, which may result in flashback. The thermocouples also have a relatively short life, requiring frequent replacement. As the thermocouples are installed in the premixing passages, the combustor needs to be dismantled to replace the thermocouples, which is relatively expensive.

It is therefore desirable to provide a combustor with a non-obtrusive, economical flashback arresting system.

SUMMARY OF THE INVENTION

Accordingly, it is the general object of the current invention to provide a combustor with a non-obtrusive flashback arresting system having a relatively long useful life, quick response time, and low repair costs.

This object, as well as other objects of the current invention, is accomplished by a combustor with a flashback arresting system for producing a hot gas by burning fuel premixed with compressed air. The combustor has fuel/air premixing passages, each of the passages having an inlet end and a discharge end. Disposed immediately upstream of the inlet ends of the fuel/air premixing passages is a fuel manifold for delivering fuel to the passages. Fuel lines with fuel flow control valves connect the fuel manifold with a fuel supply. The flashback arresting system has one or more optical flame detectors with a light receiving portion located upstream of the discharge ends of the fuel/air premixing passages and oriented toward at least a portion of at least one of the fuel/air passages. The flame detectors are responsive to light received from a flashback by their light receiving portion to transmit an output signal to a control system. The control system controls the fuel flow control valves and responds to the output signal by adjusting the fuel flow control valves to eliminate the flashback.

DESCRIPTION OF THE PREFERRED EMBODIMENT

Figure 1:
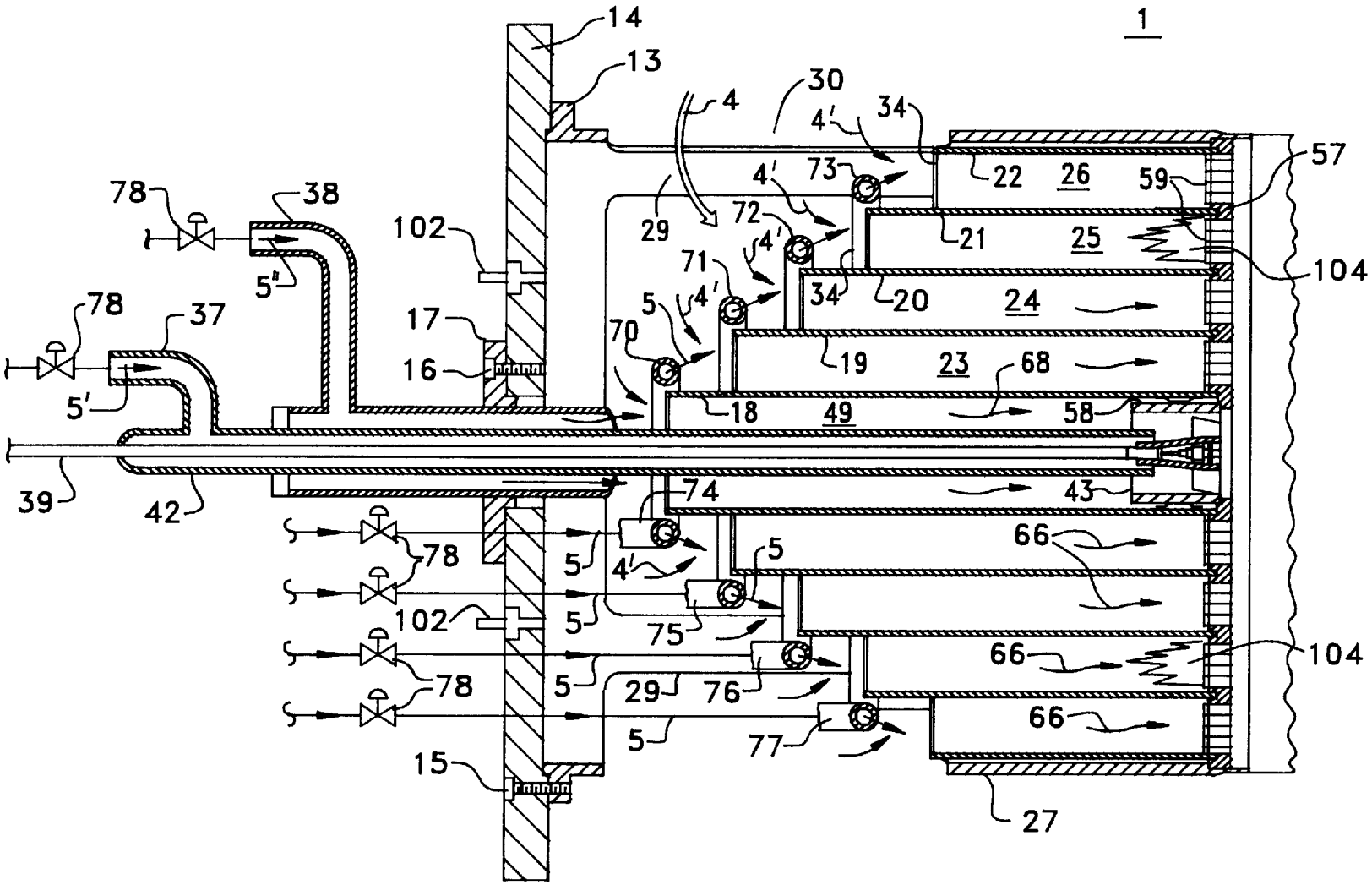
FIG. 1 is a longitudinal cross-section through the front portion of a combustor of the type more fully described in the above referenced '586 patent.

Referring to the drawings, wherein like reference numerals refer to like elements, there is shown in FIG. 1 a combustor 1 of a gas turbine as disclosed in the aforementioned '586 patent. The present invention is described herein for use in connection with the combustor described in the '586 patent, but is not limited there to except as specified in the appended claims. As more fully disclosed in the '586 patent, combustor 1 has fuel/air premixing passages 23–26 with inlet ends and outlet ends. The fuel/air premixing passages 23–26 premix air 4 with fuel 5 delivered via the toroidal manifolds 70–73 disposed upstream of the inlet ends of the passages. Other embodiments of the invention may have other arrangements for the fuel/air premixing passages and the fuel delivery manifolds.

The manifolds 70–73 are supplied with fuel 5 via fuel lines 74–77. Each fuel line has a fuel flow control valve 78 for adjusting the flow of fuel to the manifolds 70–73 and fuel pipes 37 and 38 in the combustor 1. Other embodiments of the invention may have a fuel delivery system wherein a single fuel flow control valve 78 adjusts the flow of fuel to the combustor 1.

The fuel/air premixing passages 23–26 and the manifolds 70–73 have a combustor liner 27 disposed therearound. The combustor liner 27 connects to a plate 14 forming a sealed upstream end.

Figure 2:
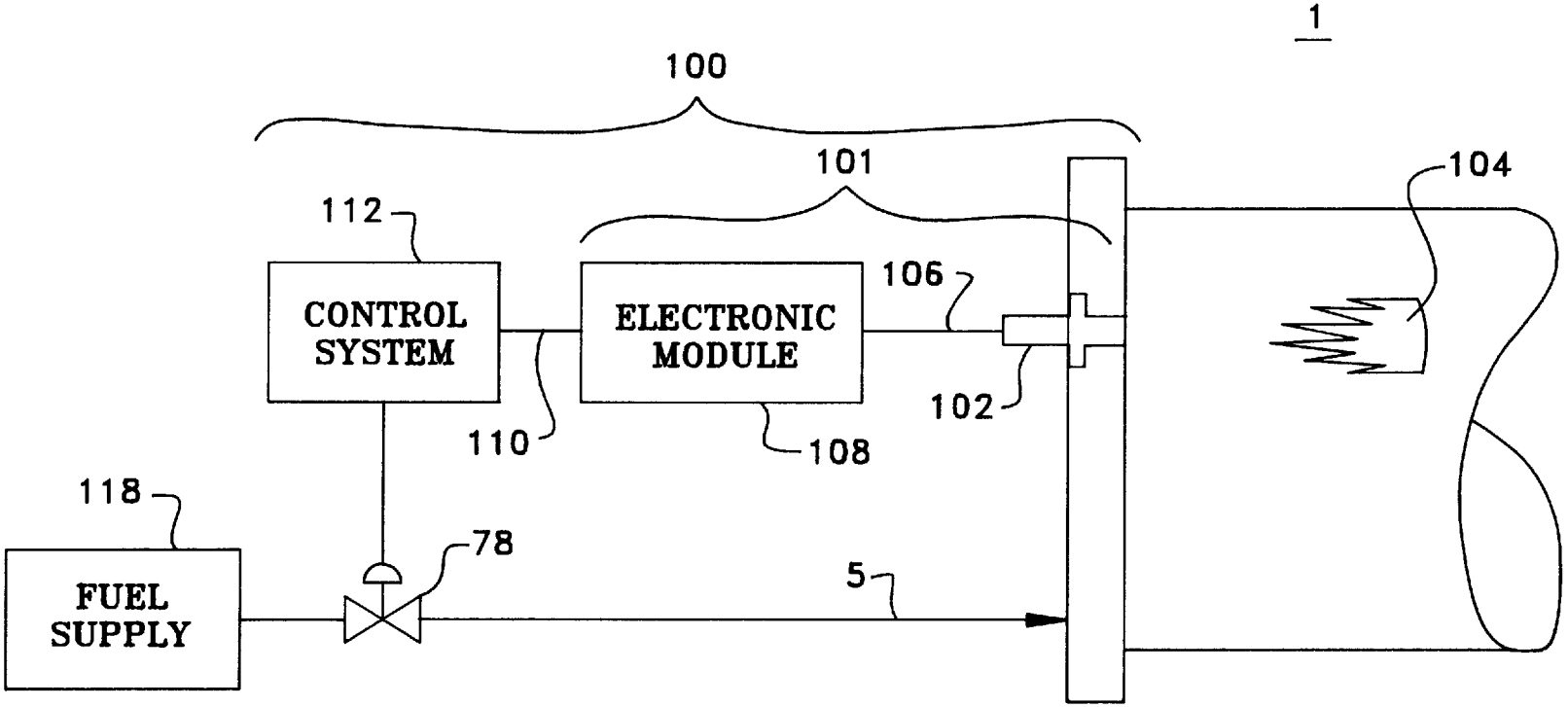
FIG. 2 is a block diagram of the flashback arresting system.

According to the invention, and referring to FIGS. 1 and 2, the combustor 1 is installed with a flashback arresting system 100. The flashback arresting system 100 comprises one or more optical flame detectors 101 and a control system 112. The optical flame detectors 101 are commercially available items offered by Rosemont Aerospace, 1256 Trapp Road, Eagan Minn. 55121 as Model 0705MA1 Flame Detector, and Ametek Power and Industrial Products, 50 Fordham Road, Wilmington, Mich. 01887 as TP10 Series Flame Detectors. Other embodiments of the invention may use other suitable optical flame detectors. Optical flame detectors have a relatively long useful life, requiring fewer repairs and replacements. The referenced flame detectors offered by Rosemount Aerospace and Ametek Power and Industrial Products each have one or more optical sensors and an electronic module for processing light signals received and transmitted by the optical sensors, as more fully described below.

The optical flame detectors 101 have a light receiving portion 102 (optical sensor) and an electronic module 108. The light receiving portion 102 transmits light 106 received therein to the electronic module 108. In the preferred embodiment of the invention, the light receiving portions 102 are mounted through the plate 14 and are oriented toward the fuel/air premixing passages 23–26. This arrangement allows the light receiving portions 102 to be removed without dismantling the combustor 1. It also does not disrupt flow patterns in the fuel/air premixing passages 23–26 Other embodiments of the invention may have the light receiving portions 102 located upstream of the manifold 70–73, upstream of the inlet ends of the passages 23–26, or located in the passages upstream of the discharge ends.

When the light 106 is received from a flashback 104 in one of the fuel/air premixing zones, the electronic module 108 generates an output signal 110. The output signal 110 is transmitted to the control system 112. In the preferred embodiment of the invention, the control system 112 is integrated with a turbine control system (not shown) that controls the operation of the turbine. The control system 112 is connected to the fuel flow control valves 78 such that it can close the valves. Upon receiving output signal 110, the control system 112 closes the fuel flow control valves 78. Once the valves 78 are closed, fuel 5 is no longer delivered from the fuel supply 118 to the combustor 1. Without the delivery of fuel, the flashback 104 is arrested. In an alternative embodiment of the invention, the control system 112 is connected to the fuel flow control valves 78 such that it adjusts the valves to change the flow of fuel. Upon receiving output signal 110, the control system 112 adjusts the valves to change the fuel/air premix ratio to eliminate flashback, without arresting the delivery of the fuel. This permits continued combustor operation.

Therefore, the invention results in lower repair costs, less frequent repairs, quicker flashback arrests, and a reduction in the creation of the harmful flow patterns in the premixing passages. Although the invention has been discussed with reference to a combustor for a gas turbine, the invention could also be practiced with respect to combustors used in other types of machinery in which arresting flashback is desirable. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A combustor for producing a hot gas by burning premixed fuel and compressed air, the combustor comprising:

a) a plurality of fuel/air premixing passages having an inlet end and a discharge end;

b) delivery means for delivering the fuel to the plurality of fuel/air premixing passages;

c) one or more fuel lines operatively connecting the delivery means to a fuel supply;

d) one or more fuel flow control valves installed in the one or more fuel lines, respectively; and e) a flashback arresting system comprising:

i) one or more optical flame detectors each having a light receiving portion, the light receiving portion being disposed upstream of the discharge ends of the plurality of fuel/air premixing passages and being oriented toward at least a portion of at least one of the fuel/air passages, the flame detectors being responsive to light received from a flashback to transmit an output signal to a control system;

ii) the control system being in operative communication with the one or more fuel flow control valves and having receiving means for receiving the output signal, the control system being responsive to the presence of the output signal by adjusting the fuel flow control valves to eliminate the flashback.

2. The combustor of claim 1, wherein each light receiving portion is disposed upstream of the inlet ends of the plurality of fuel/air premixing passages.

3. The combustor of claim 2, wherein:

a) the delivery means comprises a manifold system disposed upstream of the inlet ends of the fuel/air premixing passages; and b) each light receiving portion is disposed upstream of the manifold system.

4. The combustor of claim 3, further comprising a combustor liner disposed about the plurality of fuel/air premixing passages and the manifold system, the combustor liner having a sealed upstream end;

wherein each light receiving portion is mounted through the sealed upstream end.

5. The combustor of claim 4, wherein the sealed upstream end comprises a plate.

6. The combustor of claim 1, wherein the control system is integrated with a turbine control system.

7. The combustor of claim 1, wherein the control system being responsive to the presence of the output signal by closing the one or more fuel flow control valves.

8. A method for arresting flashback in a combustor comprising a plurality of fuel/air premixing passages, comprising the steps of:

a) detecting a flashback in at least one of the plurality of fuel/air premixing passages with an optical flame detector that is responsive to light received from the flashback to generate an output signal;

b) transmitting the output signal from the optical flame detector to a control system, the control system being responsive to the output signal by adjusting each of one or more fuel flow control valves installed in one or more fuel lines to eliminate the flashback.

9. The method of claim 8, wherein the transmitting step further comprises the step of closing each of one or more fuel flow control valves installed in one or more fuel lines to eliminate flashback.

10. A method for arresting flashback in a combustor comprising a plurality of fuel/air premixing passages, comprising the steps of:

a) detecting a flashback in at least one of the plurality of fuel/air premixing passages with an optical flame detector that is responsive to light received from the flashback to generate an output signal;

b) transmitting the output signal from the optical flame detector to a control system, the control system being operatively connected to fuel flow control valves and responsive to the output signal by adjusting the fuel/air premix ratio to eliminate the flashback by adjusting the fuel flow control valves.

* * * * *